US005728312A

United States Patent [19]

Van Doren

[11] Patent Number: 5,728,312

[45] Date of Patent: Mar. 17, 1998

[54] MOLD FOR FORMING PRECAST CONCTETE PANELS

[75] Inventor: David A. Van Doren, Hays, Kans.

[73] Assignee: Waffle-Crete International, Inc., Hays, Kans.

[21] Appl. No.: 247,060

[22] Filed: May 20, 1994

[51] Int. Cl.[6] ..... E04G 9/05

[52] U.S. Cl. ..... 249/165; 249/168

[58] Field of Search ..... 249/82, 160, 165, 249/168, 189, 192

[56] References Cited

U.S. PATENT DOCUMENTS 954,220 4/1910 Stewart ..... 249/160

2,560,783 7/1951 Scott ..... 249/160

3,063,122 11/1962 Katz ..... 249/165

4,181,286 1/1980 Van Doren ..... 249/82

*Primary Examiner*—Thomas R. Weber

*Attorney, Agent, or Firm*—Chase & Yakimo

[57] ABSTRACT

A mold especially adapted for forming precast, waffle-shaped concrete panels employs a one-piece mold body of flexible plastic sheet material to which rigid side rails are secured by tongue and groove longitudinal joints. The mold may be rapidly stripped and reset due to a hinge action provided by partial sides of the flexible body to which the rigid side rails are joined. The side rails and other structural features provide a simple mold structure that may be readily and efficiently employed for on-site production of panels. The configuration of the side rails and associated joints facilitates the replacement of a wornout mold body.

9 Claims, 4 Drawing Sheets

MOLD FOR FORMING PRECAST CONCTETE PANELS

BACKGROUND OF THE INVENTION

This invention relates to improvements in molds for forming precast structural panels and, in particular, to molds of this type having the advantages of light weight and portability and rapid stripping and resetting, and which provide an improved forming system as compared to the mold construction shown and described in my U.S. Pat. No. 4,181,286, issued Jan. 1, 1980.

In precast concrete wall and floor construction and other building applications, waffle-shaped panels and slabs provide numerous advantages including a substantial saving in material, weight and money, as well as an architecturally advantageous three-dimensional configuration. In residential and commercial buildings the waffle design offers complete freedom to fully insulate exterior walls, modular window units may be inserted in the voided areas of the waffle without sacrificing wall strength, and electrical wiring and plumbing runs can be installed after the building structure is erected. Many interior load-bearing walls and ceilings need only to be painted or textured to give a pleasing and economical open beam effect. Since the skin in the voided areas is relatively thin (as compared to the structural webs or ribs of the waffle), these areas are readily penetrated with drills and saws to facilitate plumbing and mechanical and electrical work.

Furthermore, the waffle design lends itself to the use of modular precast structural units that can be formed either at an in-plant location or at the site itself. For on-site production, it is important that the molds be lightweight and portable and easily stripped and reset for rapid production. Durability, reusability and simplicity are also important since the conveniences of a plant facility and in-plant production machinery are not available. The reinforced plastic molds shown and described in the aforesaid U.S. Pat. No. 4,181,286 answered this need for lightweight, easy-to-operate molds that are particularly suited for on-site production. Although these molds have been used for years and have proven to be very satisfactory, the efficiency of forming systems of this type is enhanced when durability can be increased, simplicity of mold design is maximized, operation is improved, and the quality of the molded product is thereby enhanced.

SUMMARY OF THE INVENTION

It is, therefore, the primary object of the present invention to provide an improved mold for forming precast panels which offers advantages and features not provided by the reinforced plastic mold shown and described in the aforesaid patent.

A specific and important object of the invention is to provide such a mold in which the sidewalls of the mold body are provided primarily by rigid side rails in direct contact with the molded product, wherein a partial wall or flap is provided at the base of each sidewall by the flexible mold body material so that hinges are formed to permit swinging movement of the sidewalls between molding positions and positions releasing the molded product after the molding process is completed.

Another important object of this invention is to provide a mold as aforesaid in which longitudinal joints between the rigid side rails and the flexible mold body material permit the same to be readily separated by simply lifting the side rails from the mold body to facilitate replacement thereof after its useful life.

Other important objects include the provision of outwardly projecting upper edge portions on the side rails which overhang the lower portions thereof to keep the mold sides clean, sharp corners on the upper inside edges of the mold sides through the use of rigid side rails rather than flexible plastic sides, corner connections which facilitate vertical separation of the side rails from the mold body when replacement is required, tapered holeformers extending through the mold sides which are simple to use and are reusable, and flexible filler pieces that may be inserted in the mold to adapt the same for the formation of a thinner molded product.

Other objects will become apparent as the detailed description proceeds.

DETAILED DESCRIPTION

Figure 7:
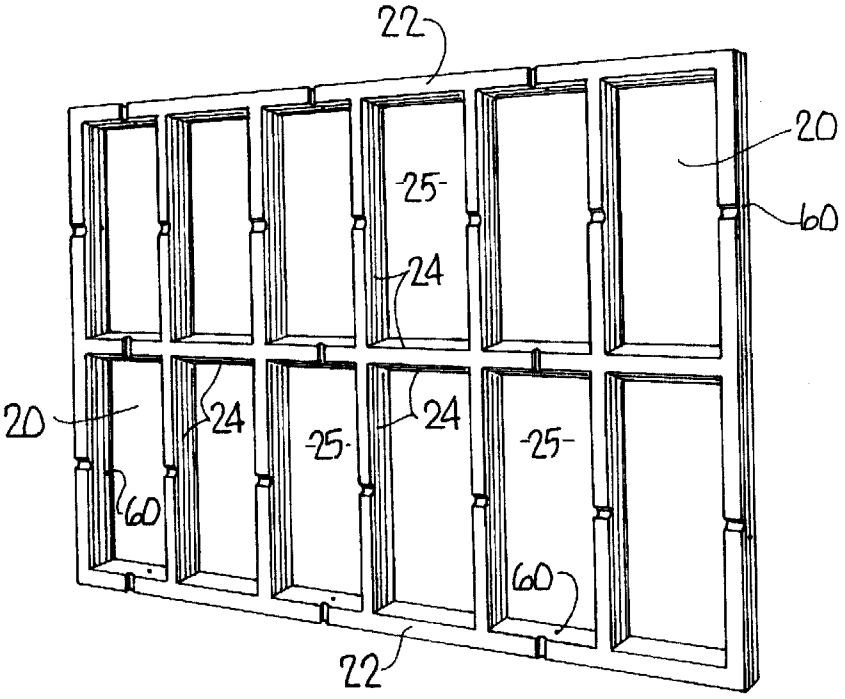
FIG. 7 is a perspective view of an exemplary finished waffle panel formed by the mold of FIG. 1.

Referring initially to FIG. 7, a precast waffle panel of the type produced by the mold of FIGS. 1–6 is illustrated. Such panel is a modular unit of reinforced concrete that may be employed either as a wall, roof or floor panel. Panels of this type are characterized by a relatively thin skin 20, thick structural sides 22 defining the periphery of the panel, and integral webs or ribs 24. The webs 24 are spaced apart at regular intervals to define voids 25 where the thickness of the panel resides solely in the skin 20. Manifestly, the presence of the voids 25 provides a substantial saving of material and reduction in weight, without significant sacrifice of strength due to the presence of the structural webs 24 and sides 22. A typical panel is 8 feet in its transverse dimension, 12 feet long, and 8 inches thick at the sides 22 and webs 24. With a 2 inch thickness for the skin 20, the panel utilizes less than half of the concrete used in a solid 8-inch wall, roof or floor.

Figure 1:
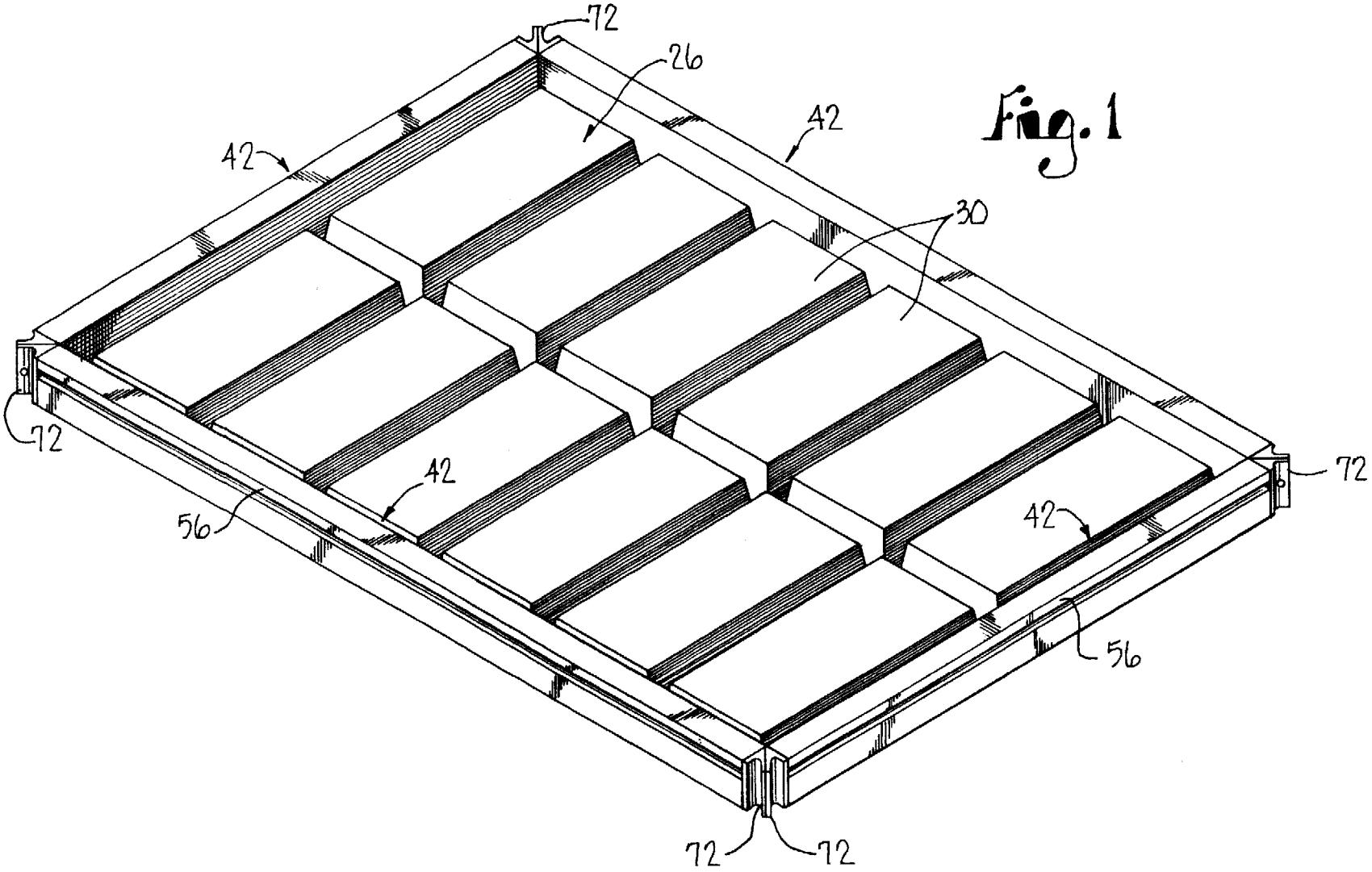
FIG. 1 is a perspective view of the mold of the present invention utilized in the production of precast waffle panels.

Now referring to FIGS. 1–6, the mold of the present invention employs a one-piece, flexible mold body having a panel-forming component 26 and four integral, partial side elements 28. The entire mold body constituting the component 26 and side elements 28 is formed from a single sheet of flexible material, such as a thermoformed ABS plastic. In order to impart the requisite waffle shape to the molded product, the forming component 26 is provided with spaced, raised portions 30. As an example, twelve such portions 30 in two rows of six each are illustrated in FIG. 1. Each of the portions 30 gives the appearance of a platform elevated above a base lattice 32 (see FIG. 2) which forms a grid at the bottom of the mold.

Each raised portion 30, by virtue of the use of a single piece of plastic sheet material, presents a downwardly facing cavity which is filled by a rigid plastic form 34. This structurally reinforces the component 26 and rigidifies the raised portions 30, and also insulates the mold to assist in curing.

The two longitudinal and two transverse partial side elements 28 are pliable due to the flexible nature of the plastic sheet material and, therefore, present flaps swingable about lines of bend 36 at the merger of the side elements 28 with the outside edges of the lattice or grid portion 32 of the mold body to provide a hinge action for a purpose to be discussed. Each side element 28 terminates at an upper, free longitudinal edge 38 which is received within a complimentary longitudinal groove 40 formed in a tubular side rail 42. There are two longitudinal and two transverse side rails 42 coextensive with their associated side elements 28. Each side rail 42 and associated partial side element 28, therefore, form a complete sidewall of the mold body which compliments the panel-forming component 30 to impart the waffle configuration to the molded product. The side rails 42 are preferably formed from aluminum extrusions and thus present rigid box members surrounding the mold body which have sufficient structural strength to resist deformation under outwardly directed forces against the sidewalls produced when the mold body is filled with concrete. As disclosed in the aforesaid U.S. Pat. No. 4,181,286, it is important that the sides of the mold body be constructed such that outward bowing cannot occur when the mold is filled with concrete.

Figure 2:
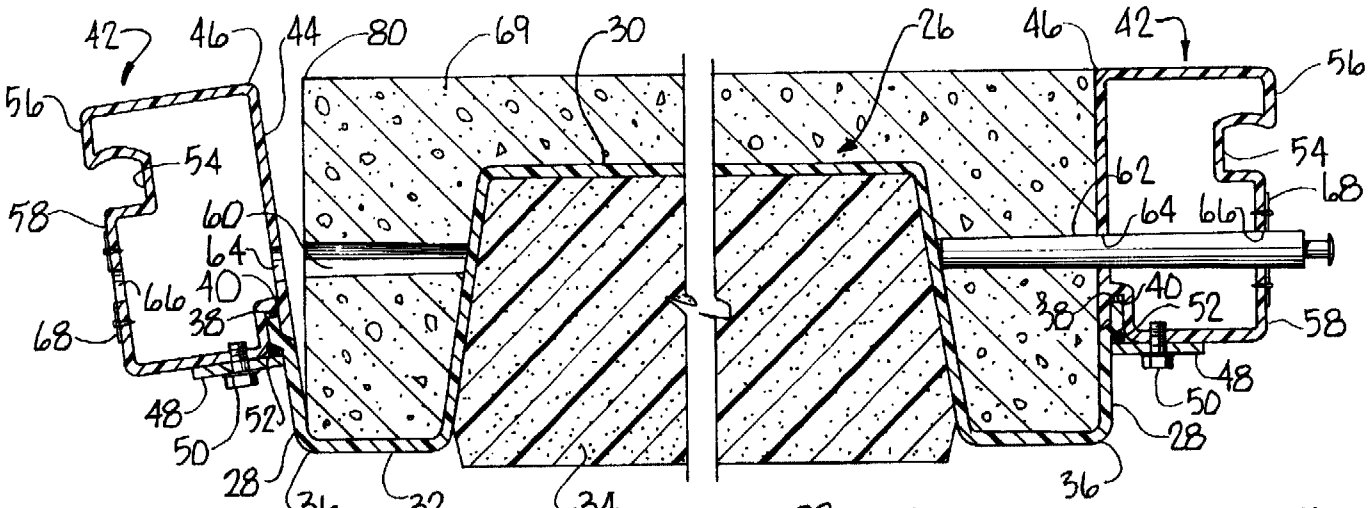
FIG. 2 is an enlarged, fragmentary view (partially in elevation and partially in vertical cross-section) of the mold of FIG. 1 filled with concrete, one of the sidewalls of the mold being shown swung outwardly to release the mold from the waffle panel.
Figure 6:
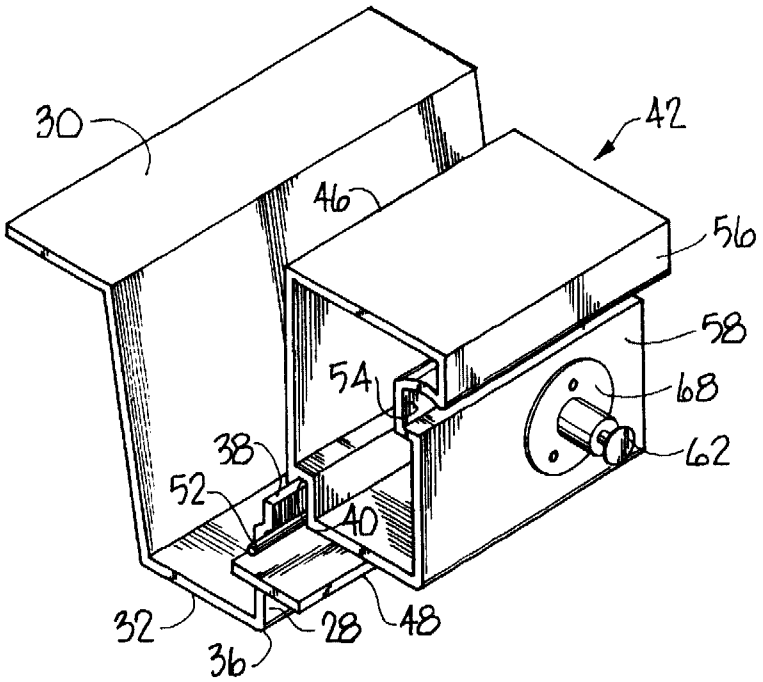
FIG. 6 is an enlarged, fragmentary, perspective view showing the joint between one of the side rails and the plastic mold body and revealing the outer end of one of the holeformers, parts being broken away at the joint to show details of construction.

The longitudinal joint between each side rail 42 and its associated partial side element 28 is best shown by a comparison of FIGS. 2 and 6. A tongue and groove connection is provided, the tongue thereof being formed by the Z-shaped upper longitudinal margin of the side element 28 which presents the longitudinal edge 38. The groove 40 in the tubular extrusion comprising side rail 42 is disposed at the lower, inner corner of the rail and thus the partial element 28 and rail 42, when joined, present a continuous inwardly facing molding surface 44. It should be appreciated that surface 44 is continuous and uninterrupted from the line of bend 36 upwardly to a right-angle corner 46 of the side rail 42 which defines the inner upper edge of the rail. A retainer strap 48 is secured to the bottom of rail 42 by screws 50 to hold the mated tongue and groove components together to prevent separation thereof, a spacer rod 52 being sandwiched between the strap 48 and the Z-shaped bend in side element 28 to hold the mated joint components in place by a clamping action. Both the retainer strap 48 and the spacer rod 52 are preferably aluminum.

Each side rail 42 has a longitudinal recess 54 in its outer side which serves as a finger hold for lifting and carrying the mold and also facilitates the clipping or clamping of an insulated cover (not shown) over the mold body. The outer upper edge portion 56 of the rail 42 above the recess 54 projects outwardly beyond the lower portion 58 of rail 42 below recess 54 in order to provide an overhang so that any concrete that may overflow during the molding process will not drip and adhere to lower portion 58. This keeps the mold sides clean and prevents spillage from interfering with the use of the forming system of the present invention.

The forming of holes or passages 60 (FIG. 2) in the molded product is facilitated by the use of an elongated, tapered, cylindrical holeformer 62 at locations where it is desired to form through holes 60 in the sides 22 of the waffle panel (FIG. 7) for bolts that will be employed to assemble the finished panels into the desired structure. An inner wall opening 64 in the side rail 42 is aligned with an outer opening 66 of slightly larger diameter for the purpose of receiving the tapered holeformer 62, which may then be held in place by an annular retainer 68.

Figure 5:
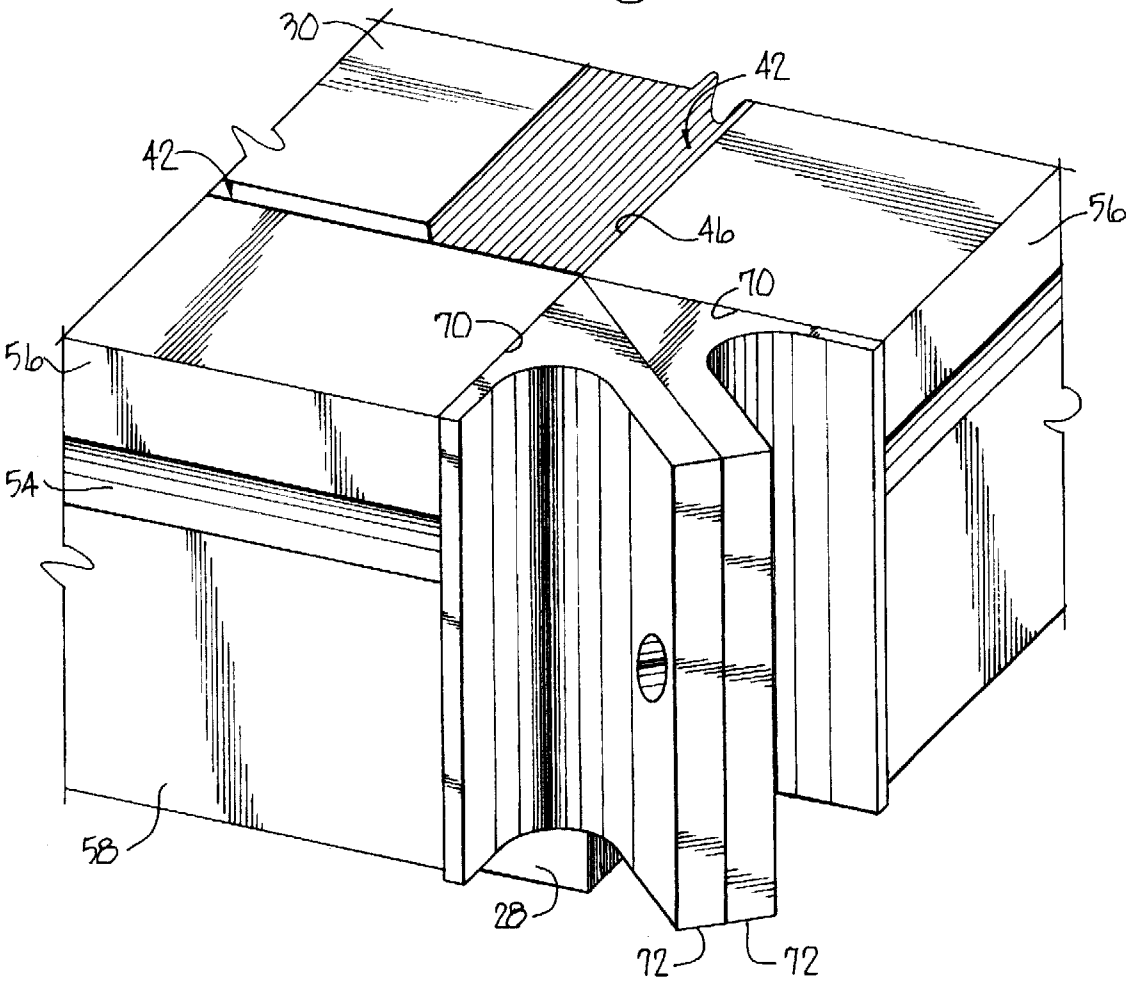
FIG. 5 is an enlarged, fragmentary, perspective view of one of the corners of the mold showing the same closed, the fastener for the end caps being removed for clarity.
Figure 4:
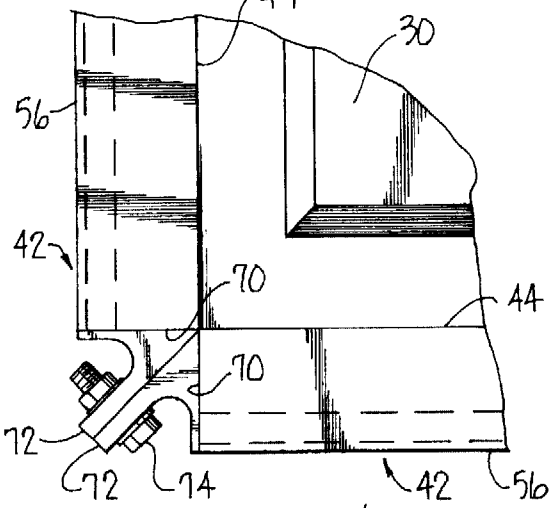
FIG. 4 is a plan view of one corner of the mold of FIG. 1 on a reduced scale as compared to FIG. 2.

Referring to FIG. 2, it may be seen that the left sidewall of the mold there illustrated is shown in a partially open position separated from a concrete panel 69 which has cured in the mold. It may be appreciated, therefore, that the sidewalls of the mold have free end edges so that the four corners of the mold can be closed when casting the panel 69 and then opened to strip the mold once the concrete is cured. FIG. 4 reveals the free end edges 70 of two of the side rails 42 at one of the corners of the mold. An end cap 72 on each end edge 70 is secured to the adjacent end cap 72 by a bolt 74 to hold the corner closed. As illustrated in FIG. 5, the end caps 72 may be composed of aluminum and welded directly to the ends of the side rails 42. It should be appreciated that each end edge 70 lies in a vertical plane and that the surface-to-surface contact of the two end caps 72 (FIG. 4) likewise occurs in a vertical plane so that a simple and strong corner connection is provided by securing the two end caps 72 with the bolt 74. Furthermore, these components do not interfere with lifting the side rails 42 vertically off of the side elements 28 when it is necessary to replace the plastic mold body.

Figure 3:
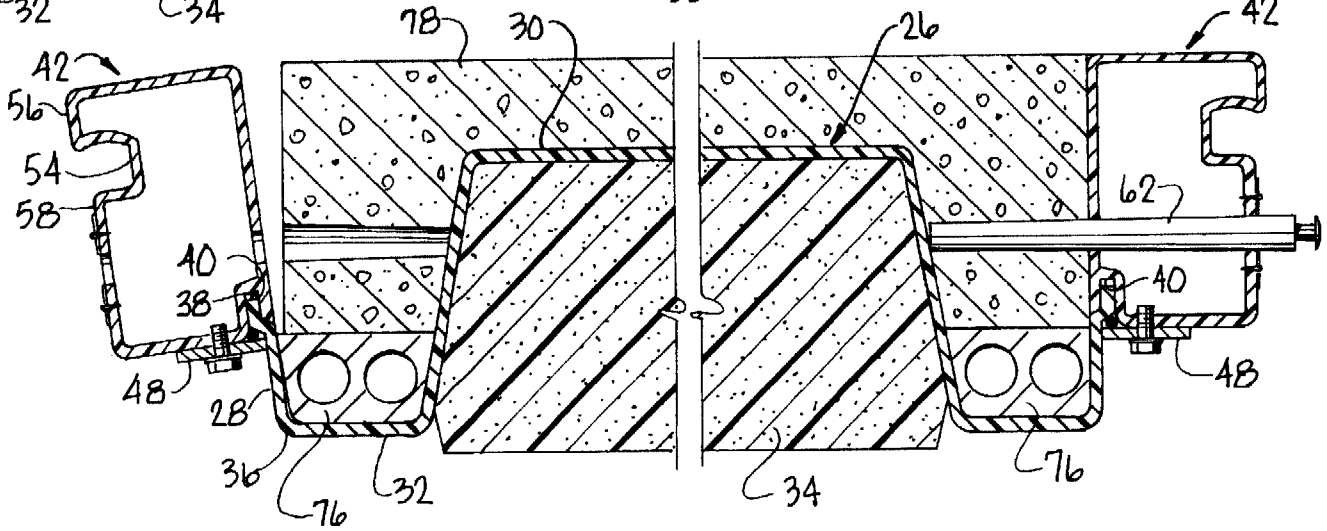
FIG. 3 is a view similar to FIG. 2 but showing filler pieces inserted in the mold to reduce the thickness of the panel.

Removable adapters 76 are shown in FIG. 3 installed in the bottom of the panel-forming component 26 in order to provide a thinner panel product 78 for lighter duty applications. The adapters 76 are flexible, PVC filler pieces and may be removed when it is desired to make the full panel 69 seen in FIG. 2. The adapters 76 would be employed, for example, to convert an eight-inch panel form to a six-inch form thereby producing the lighter, thinner panel 78.

Use of a mold of the general type disclosed herein is set forth in detail in the specification of the aforesaid U.S. Pat. No. 4,181,286 which is incorporated herein by reference as may be necessary for a full and complete understanding of the use and general operation of the mold disclosed herein. The improved forming system of the present invention, however, provides principally metal side surfaces 44 in contact with the molded product and thus a sharp upper, outer edge 80 is imparted to the molded product by the right angle corners 46 of the side rails 42. The tapered holeformers 62 are easily installed and removed and are reusable. The mold sides are kept clean by the projecting outer upper portions 56 of the side rails.

An important advantage in day-to-day operations is the structural simplicity of the improved forming system of the present invention and the ease by which a worn-out mold body may be replaced. To close the corners of the form for molding, the sidewalls are swung on the hinges provided by the partial side elements 28 to their upright positions and the bolts 74 are inserted and secured in the end caps 72. This simple operation closes the four corners of the mold. The holeformers 62 may then be inserted as desired. Once the concrete is cured, stripping is readily accomplished by removing the four bolts 74 at the corners and pulling the four sidewalls away from the molded product. The sidewalls swing outwardly about the lines of bend 36 at the base of the side elements 28.

The longitudinal tongue and groove joints between the side rails 42 and the side elements 28 facilitate the replacement of a worn mold body. The screws 50 are loosened to remove the retainer straps 48, whereupon the side rails 42 can be simply lifted off of the plastic body sides. As the end caps 72 are welded to the side rails 42, this one operation (separation of the tongue and groove joints) disassembles all metallic components from the plastic mold body for reuse. The side rails 42 are readily remounted on a replacement mold body by attaching the side rails to the replacement body at the tongue and groove joints and securing the retainer straps 48.

Having thus described the invention, what is claimed as new and desired to be secured by Letters Patent is as follows:

1. A mold for forming precast panels, said mold comprising:

a mold body configured to impart a desired shape to a molded product formed therein, said body having a panel-forming component provided with a plurality of integral, flexible, partial side elements presenting pliable flaps at the periphery of the body swingable on said component, each of said elements presenting a lower portion of an inwardly facing molding surface and terminating at a longitudinal edge, a plurality of rigid side rails on respective elements longitudinally coextensive therewith, each of said side rails projecting from the longitudinal edge of the corresponding element and cooperating therewith to provide a sidewall of the mold body complementing said panel-forming component, each of said side rails presenting an upper portion of the normally inwardly facing molding surface contiguous with said lower portion presented by the corresponding element so that the contiguous surfaces provide the complete, continuous molding surface for forming the molded product, joint means presented by said longitudinal edges of said side elements mating with respective side rails for interconnecting the same and permitting the side rails and elements to separate from one another at said longitudinal edges by relative movement in transverse directions generally in the plane of the respective sidewall to facilitate replacement of said mold body, releasable retaining means on said sidewalls for preventing said relative transverse movement of the side rails and elements until replacement of the mold body, said joint means permitting differential longitudinal movement of the associated side rail and element, said pliable flaps presented by said elements providing hinge means for swinging movement of the sidewalls on said component outwardly from normal, molding positions and away from a molded product within the mold body to permit said product to be withdrawn therefrom, adjacent pairs of said sidewalls having proximate end edges defining closed corners of the body when said sidewalls are in their normal positions and, upon said outward swinging movement of the sidewalls, said end edges separating to cause said corners to open, and releasable means associated with said end edges for holding the corners closed to maintain the sidewalls in their normal positions during the molding process.

2. The mold as claimed in claim 1, wherein said components of each joint present a tongue and groove connection.

3. The mold as claimed in claim 1, wherein said side rails are of tubular, metallic construction and have sufficient structural strength to resist deformation under outwardly directed forces against said sidewalls produced when the mold body is filled.

4. The mold as claimed in claim 3, wherein each of said side rails has an outwardly projecting upper edge portion overhanging a lower portion thereof to direct overflowing material clear of said lower portion.

5. The mold as claimed in claim 3, wherein each of said side rails has an inner, upper edge presenting an essentially right-angle corner for imparting a sharp edge to the molded product.

6. The mold as claimed in claim 1, wherein said rigid side rails have sufficient structural strength to resist deformation under outwardly directed forces against said sidewalls produced when the mold body is filled.

7. The mold as claimed in claim 1, wherein said distal end edges of the respective sidewalls lie in substantially orthogonal transverse planes at respective corners of the mold body, and wherein said releasable corner-holding means comprises end caps on respective end edges of the sidewalls and fasteners joining adjacent end caps at the corners of the mold body.

8. The mold as claimed in claim 1, wherein at least certain of said side rails have openings therethrough communicating with the interior of the mold body, and further comprising a plurality of tapered holeformers received in corresponding openings and extending into said mold interior.

9. The mold as claimed in claim 1, further comprising a removable, flexible filler piece in said panel-forming component adapting the same for the formation of a thinner molded product.

* * * * *

UNITED STATES PATENT AND TRADEMARK OFFICE

CERTIFICATE OF CORRECTION

PATENT NO. : 5,728,312

DATED : March 17, 1998

INVENTOR(S) : David A. Van Doren

It is certified that error appears in the above-identified patent and that said Letters Patent is hereby corrected as shown below:

In the Title, delete "CONCTETE" and substitute --CONCRETE--.

Column 1, in the Title, delete "CONCTETE" and substitute --CONCRETE--.

Column 6, line 33, delete "distal".

Signed and Sealed this

Sixteenth Day of June, 1998

*Attest:*

*Attesting Officer*

Bruce Lehman

BRUCE LEHMAN

*Commissioner of Patents and Trademarks*